US008191815B2

(12) United States Patent
Huang

(10) Patent No.: US 8,191,815 B2
(45) Date of Patent: Jun. 5, 2012

(54) AUTO-REVERSIBLE REEL

(76) Inventor: Yuh-Lin Huang, Taipei (TW)

( * ) Notice: Subject to any disclaimer, the term of this patent is extended or adjusted under 35 U.S.C. 154(b) by 168 days.

(21) Appl. No.: 12/828,538

(22) Filed: Jul. 1, 2010

(65) Prior Publication Data

US 2012/0001008 A1 Jan. 5, 2012

(51) Int. Cl.
*B65H 75/48* (2006.01)

(52) U.S. Cl. ..... 242/379; 242/379.2; 242/380; 242/404.3

(58) Field of Classification Search ..... 242/379, 242/379.2, 380, 404.3
See application file for complete search history.

(56) References Cited

U.S. PATENT DOCUMENTS

| | | | | | |
|---|---|---|---|---|---|
| 1,567,783 | A * | 12/1925 | Best | ..... | 242/376 |
| 3,150,843 | A * | 9/1964 | Cordoba et al. | ..... | 242/380 |
| 4,146,191 | A * | 3/1979 | Cavanaugh | ..... | 242/379.2 |
| 4,730,783 | A * | 3/1988 | Lamson | ..... | 242/375.1 |
| 5,683,054 | A * | 11/1997 | Chen | ..... | 242/376 |
| 5,833,165 | A * | 11/1998 | Paugh | ..... | 242/379.2 |
| 6,073,875 | A * | 6/2000 | Paugh | ..... | 242/379.2 |
| 6,290,158 | B1 * | 9/2001 | Huang | ..... | 242/379 |
| 2008/0035778 | A1 * | 2/2008 | Belden et al. | ..... | 242/375 |

FOREIGN PATENT DOCUMENTS

| | | |
|---|---|---|
| TW | M376152 | 12/1999 |
| TW | M392686 | 6/2000 |

* cited by examiner

*Primary Examiner* — Sang Kim
(74) *Attorney, Agent, or Firm* — Guice Patents PLLC

(57) ABSTRACT

An auto-reversible reel includes a wheel-shaped housing, a rotor rotatably mounted in the housing, a pull rope fastened to and winding round the rotor, a control member fastened to one end of the pull rope outside the housing and operable to pull the pull rope out of the housing, and a power spring adapted for reversing the rotor to take up the pull rope. The rotor has a retaining block located on the inside wall thereof and a stop plate extending over the retaining block. The power spring has a retaining hole located on the outer end thereof and fastened to the retaining block of the rotor in such a manner that the stop plate prohibits disconnection of the outer end of the power spring from the retaining block.

13 Claims, 13 Drawing Sheets

AUTO-REVERSIBLE REEL

BACKGROUND OF THE INVENTION

1. Field of the Invention

The present invention relates to rope reels and more particularly to a multipurpose auto-reversible reel for a wide range of applications. The auto-reversible reel can be used to carry a personal item, such as key ring, cell phone, induction card, identification card, outdoor upholstery or exhibition article. This auto-reversible function facilitates the use of the attached personal object and prevents loss or falling of the attached personal object.

2. Description of the Related Art

A reversible reel is known comprising a wheel-shaped housing, a spring-loaded rotor rotatably mounted in the housing and a pull rope wound round the spring-loaded rotor. The pull rope has its one end fastened to the spring-loaded rotor, and its other end extending out of the housing for the connection of a personal item, such as key ring, cell phone, induction card, etc. Further, a reversible reel can be made in the form of a tape measure.

Taiwan utility model patent number 376152 discloses an auto-reversible reel, entitled "Improved structure of auto-reversible reel", issued to the present inventor. According to this design, the auto-reversible reel comprises a housing formed of a top cover shell and a bottom cover shell, a bobbin (rotor) formed of a male member and a female member and rotatably mounted in the housing, a pull rope wound round the bobbin and having its one end affixed to the bobbin and its other end extended out of the housing, a coil spring mounted in the bobbin and adapted for reversing the bobbin after the bobbin has been rotated to wind up the pull rope, and a clip located on the back side of the bottom cover shell. The top cover shell has a bush mounted thereof. The bush has a diameter smaller than the top cover shell, and a width greater than the width of the top cover shell. After installation of the bush in the top cover shell, a part of the bush extends of the top cover shell for the mounting of the bottom cover shell. Further, a rivet is inserted through a center hole on the bottom cover shell, an axial hole on the bobbin and a center hole on the bush and riveted to the bush. Further, an ornamental pad is sandwiched between the top cover shell and the bush and exposed to the outside through an opening on the top cover shell. Further, the male and female members of the bobbin define a coil spring accommodation space and a pull rope accommodation space.

Further, Taiwan utility model patent number 392686 discloses an auto-reversible reel, entitled "All-direction reel and its rope end positioning structure". According to this design, the all-direction reel comprises a housing, a bobbin rotatably mounted in the housing to wind up a pull rope, a power spring for reversing the bobbin, a clip fastened to one side of the housing thereof and a control member disposed outside the housing. The clip has a circular protrusion and a through hole cut through the circular protrusion. The housing has circular recess located on one side thereof for the positioning of the circular protrusion of the clip. Further, a screw bolt is inserted through the through hole of the clip and a hole on the housing and fastened to a bobbin inside the housing. The screw bolt has a shoulder fitted into the through hole of the clip. The control member is a hollow member, having a hole on the top side for the passing of the outer end of the pull rope. The outer end of the pull rope is inserted through the hole of the control member and a hole on a ball, and then tied up to form a knot that prohibits falling of the ball from the pull rope. The housing further has a flanged hole located on the periphery for the passing of the pull rope. When the pull rope is wound round the bobbin, the ball is received inside the control member and peripherally partially protruding over the hole of the control member and engaged into the flanged hole to secure the control member to the periphery of the housing. Thus, the housing can be rotated relative to the pull rope so that the control member can be operated to pull the pull rope out of the housing in any direction without causing damage and the control member can be pulled back and positioned on the periphery of the housing accurately and automatically after release of the external pulling force.

In the aforesaid two prior art designs, the connection structure that secures the outer end of the coil spring (power spring) to the bobbin is not stable. The outer end of the coil spring (power spring) may be disengaged from the bobbin accidentally, causing the auto-reversible reel unable to wind up the pull rope. Further, the connection between the pull rope and the bobbin is not well protected. The inner end of the pull rope may break easily when the user operates the control member to pull the pull rope out of the housing.

Therefore, it is desirable to provide an auto-reversible reel that eliminates the aforesaid problems.

SUMMARY OF THE INVENTION

The present invention has been accomplished under the circumstances in view. It is therefore the main object of the present invention to provide an auto-reversible reel, which allows the pull rope to be pulled out of the housing in any direction, and which enhances the strength of the shaft to support positive rotation of the rotor in the housing.

According to one aspect of the present invention, an auto-reversible reel comprises a wheel-shaped housing, a rotor rotatably mounted in the housing, an operation control device, which comprises a pull rope fastened to and winding round the rotor and a control member fastened to one end of the pull rope outside the housing and operable to pull the pull rope out of the housing, and a power spring adapted for reversing the rotor to take up the pull rope. The rotor has a retaining block located on the inside wall thereof and a stop plate extending over the retaining block. The power spring has a retaining hole located on the outer end thereof and fastened to the retaining block of the rotor in such a manner that the stop plate prohibits disconnection of the outer end of the power spring from the retaining block.

According to another aspect of the present invention, the power spring has a side opening located on one lateral side of the outer end thereof in communication with the retaining hole, the width of said side opening being shorter than the diameter of said retaining hole, and two hooked portions disposed at two opposite lateral sides of said side opening. Further, the width of the side opening is shorter than the diameter of the retaining hole. Further, the retaining block of the rotor is configured to fit the configuration of the retaining hole, side opening and hooked portions of the power spring so that the retaining hole of the power spring can be positively fastened to the retaining block to secure the outer end of the power spring to the rotor. Further, the stop plate supports the power spring in the rotor, reducing the pressure at the connection point between the retaining hole and the retaining block during working of the power spring, and prohibiting escape of the retaining hole from the retaining block. Subject to the aforesaid arrangement, the power spring needs not to receive a tempering treatment but simply needs to bear the constant axial tensile force from the stop plate. When the power spring is rotated about the shaft, the hoop force thus produced is converted into a constant axial tensile force subject to the fulcrum effect of the stop plate, reducing the pressure between the outer end and hooked portions of the power spring and enabling the pressure to be divided into two components that are respectively distributed through the outer end of the power spring and the stop plate, and therefore the outer end of the power spring will not break during rotating of the power spring.

Further, a clip or magnet may be fastened to the housing for mounting.

Further, the control member of the operation control device provides a positioning function for positive positioning on the housing after a reverse rotation of the rotor to wind the pull rope.

DETAILED DESCRIPTION OF THE PREFERRED EMBODIMENT

Figure 1:
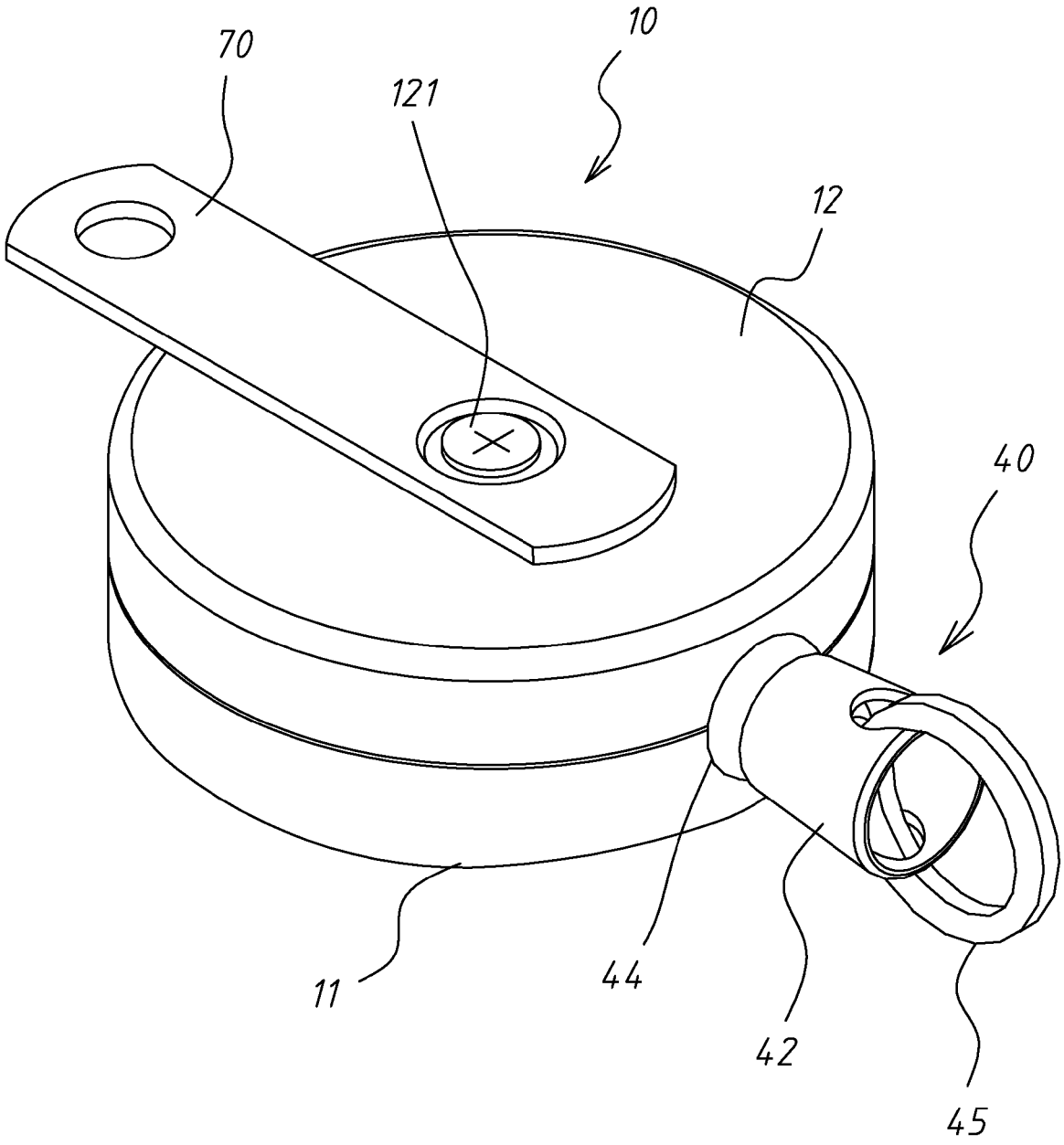
FIG. 1 is an oblique elevation of an auto-reversible reel in accordance with the present invention.
Figure 2:
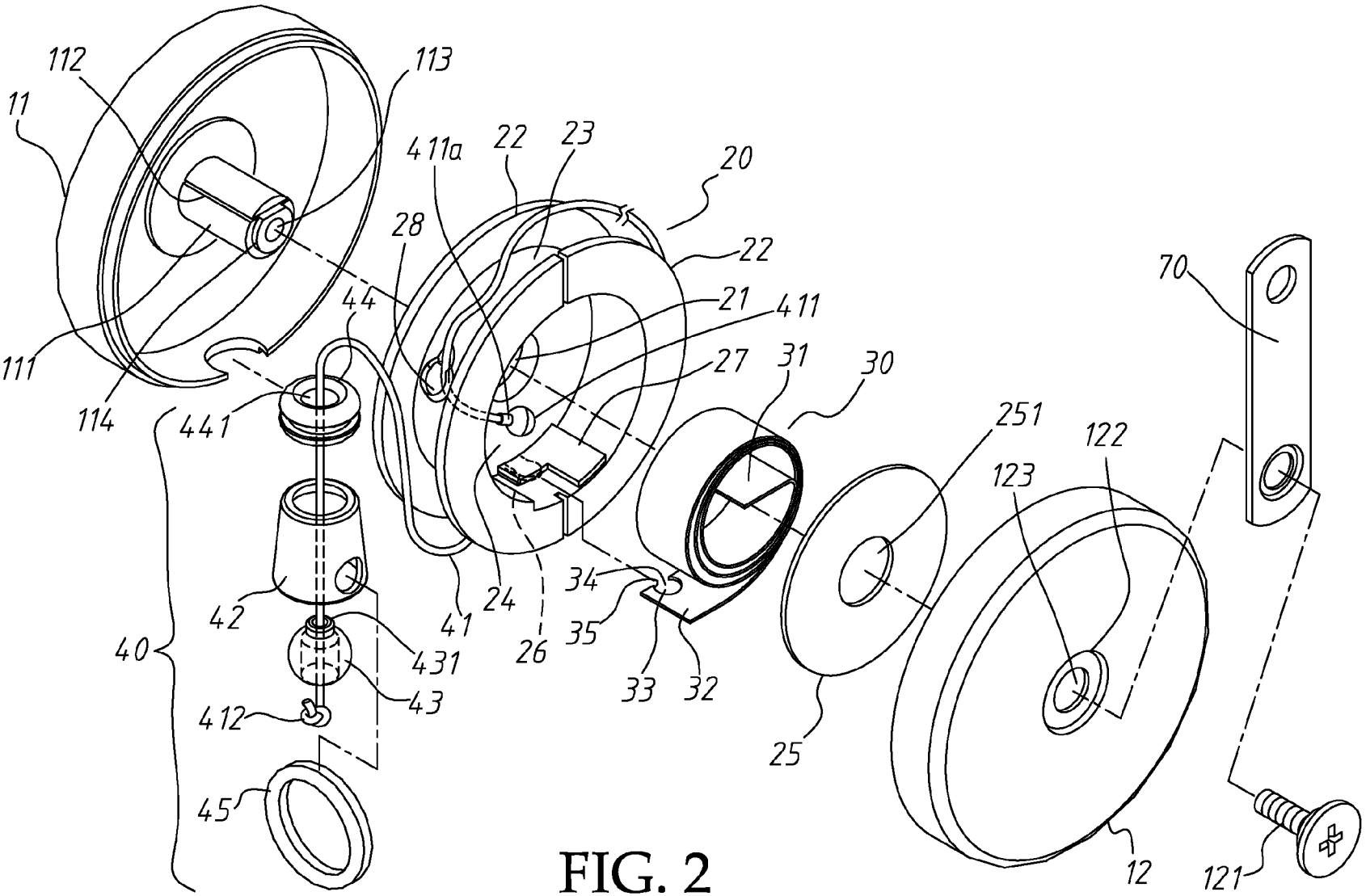
FIG. 2 is an exploded view of the auto-reversible reel in accordance with the present invention.
Figure 3:
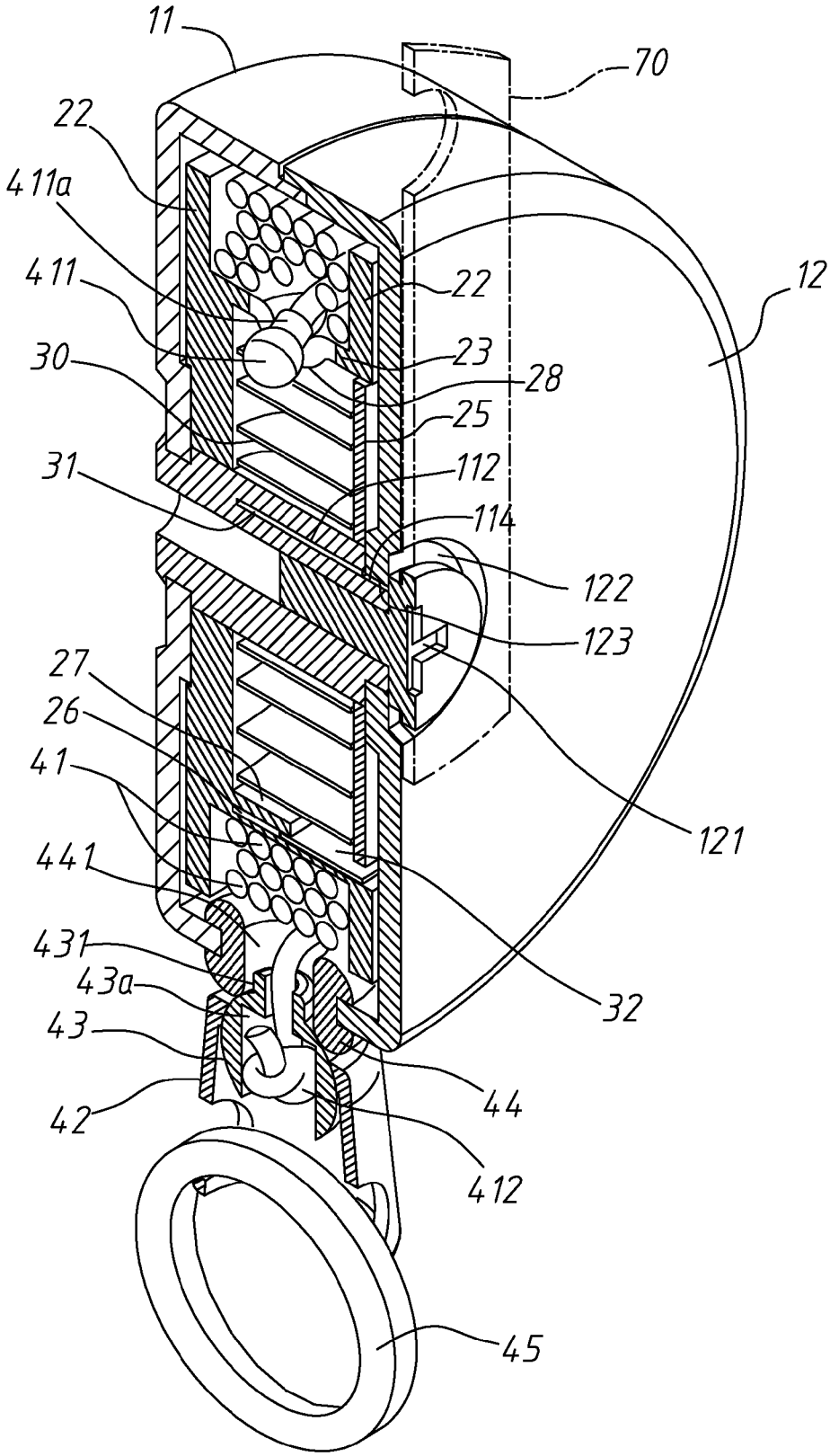
FIG. 3 is a sectional elevation of the auto-reversible reel in accordance with the present invention.

Referring to FIGS. 1~3, an auto-reversible reel in accordance with a first embodiment of the present invention is shown comprising a housing 10, a rotor 20, a power spring 30 and an operation control device 40.

The housing 10 is shaped like a wheel. However, it is to be understood that the housing 10 can be made in any of a variety of other shapes. According to this embodiment, the housing 10 is formed of a left cover shell 11 and a right cover shell 12. The left cover shell 11 has a shaft 111 located on the inside at the center, a longitudinal crevice 111 cut through the shaft 111 and dividing the shaft 111 into two unequal parts each having a D-shaped cross section, a locating hole 113 located on the distal end of the shaft 111 at the center and a step 114 located on the distal end of the shaft 111 around the locating hole 113. The right cover shell 12 and the left cover shell 11 are attached together, and then a fastening member (for example, screw) 121 is inserted through a center hole 123 on the right cover shell 12 and driven into the locating hole 113 to affix the right cover shell 12 and the left cover shell 11 together (see FIG. 3). Further, a connection member 70 is rotatably coupled to the fastening member 121 between the head of the fastening member 121 and the outside wall of the right cover shell 12. Further, the connection member 70 can be a clip or magnet.

The rotor 20 is accommodated inside the housing 10 between the left cover shell 11 and the right cover shell 12, comprising a hollow cylindrical body 23, an axial hole 21 cut through the hollow cylindrical body 23 for the passing of the shaft 111, two flanges 22 respectively radially extending around the two distal ends of the periphery of the hollow cylindrical body 23, a power spring accommodation chamber 24 defined in one side, namely, the right side of the hollow cylindrical body 23 for accommodating the power spring 30, a cover plate 25. which is attached to the right side of the hollow cylindrical body 23 to block the power spring accommodation chamber 24 after installation of the power spring 30 in the power spring accommodation chamber 24 and has a center hole 251 for the passing of the shaft 111 (see FIG. 3), and a retaining block 26 and a stop plate 27 located on the inside wall of the power spring accommodation chamber 24. The cover plate 25 is press fitted into the power spring accommodation chamber 24 and stopped against one side of the stop plate 27 to protect the stop plate 27 against deformation and to provide a secondary support between the shaft 111 and the rotor 20 for rotary balance, avoiding vibration and friction noise during rotation of the rotor 20 and enhancing pull strength. Further, the two flanges 22 and the periphery of the periphery of the hollow cylindrical body 23 define an annular space for the winding of a pull rope.

Figure 4:
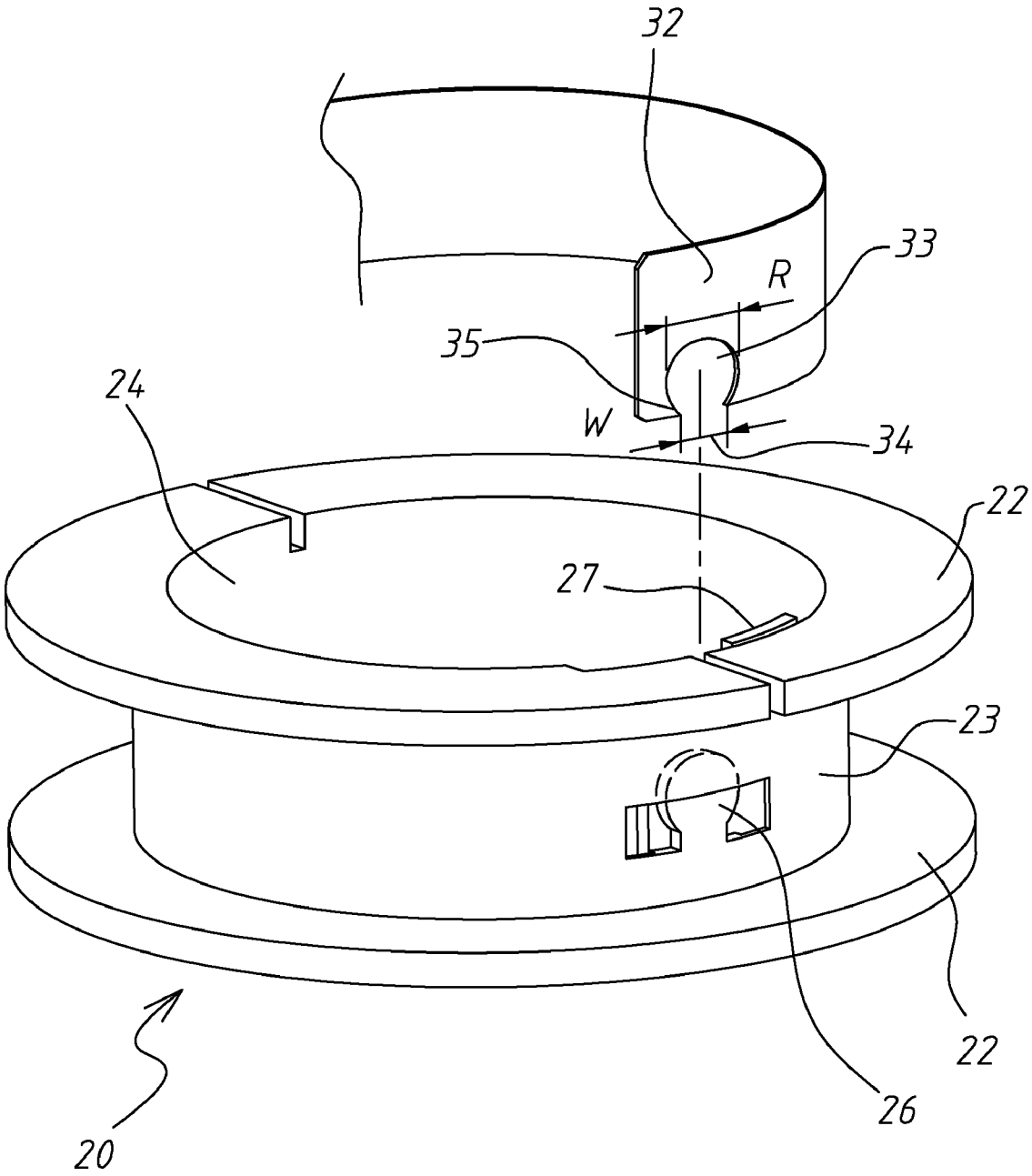
FIG. 4 is an enlarged view of a part of the present invention, showing the mounting structure between the outer end of the power spring and the rotor.

The power spring 30 is accommodated in the power spring accommodation chamber 24 around the shaft 111, having an inner end 31 fastened to the longitudinal crevice 112 at the shaft 111 and its outer end 32 inserted in between the stop plate 27 and the inside wall of the power spring accommodation chamber 24 and secured to the retaining block 26. Further, the power spring 30 has a retaining hole 33 located on the outer end 32, as shown in FIG. 4, a side opening 34 located on one lateral side of the outer end 32 in communication with the retaining hole 33 and two hooked portions 35 disposed at two opposite lateral sides of the side opening 34. Further, the width W of the side opening 34, i.e., the distance between the two hooked portions 35 is shorter than the diameter R of the retaining hole 33. Further, the retaining block 26 that is located on the inside wall of the power spring accommodation chamber 24 is configured to fit the configuration of the retaining hole 33, side opening 34 and hooked portions 35 of the power spring 30. The retaining hole 33 of the power spring 30 is fastened to the retaining block 26 so that the outer end 32 of the power spring 30 is secured to the inside of the power spring accommodation chamber 24. Further, the stop plate 27 supports the power spring 30 in the power spring accommodation chamber 24, reducing the pressure at the connection point between the retaining hole 33 and the retaining block 26 during working of the power spring 30 and prohibiting escape of the retaining hole 33 from the retaining block 26.

Subject to the configuration design of the retaining hole 33, side opening 34 and hooked portions 35 of the power spring 30, the power spring 30 needs not to receive a tempering treatment but simply needs to bear the constant axial tensile force from the stop plate 27. When the power spring 30 is rotated about the shaft 111, the hoop force produced between the inside wall of the rotor 20 and the shaft 111 is converted into a constant axial tensile force subject to the fulcrum effect of the stop plate 27, reducing the pressure between the outer end 32 and hooked portions 35 of the power spring 30 and enabling the pressure to be divided into two components that are respectively distributed through the outer end 32 of the power spring 30 and the stop plate 27, and therefore the outer end 32 of the power spring 30 will not break during rotating of the power spring 30 about the shaft 111. Further, the rotor 20 has a ball socket 28 formed integral with the periphery of the hollow cylindrical body 23.

Figure 5:
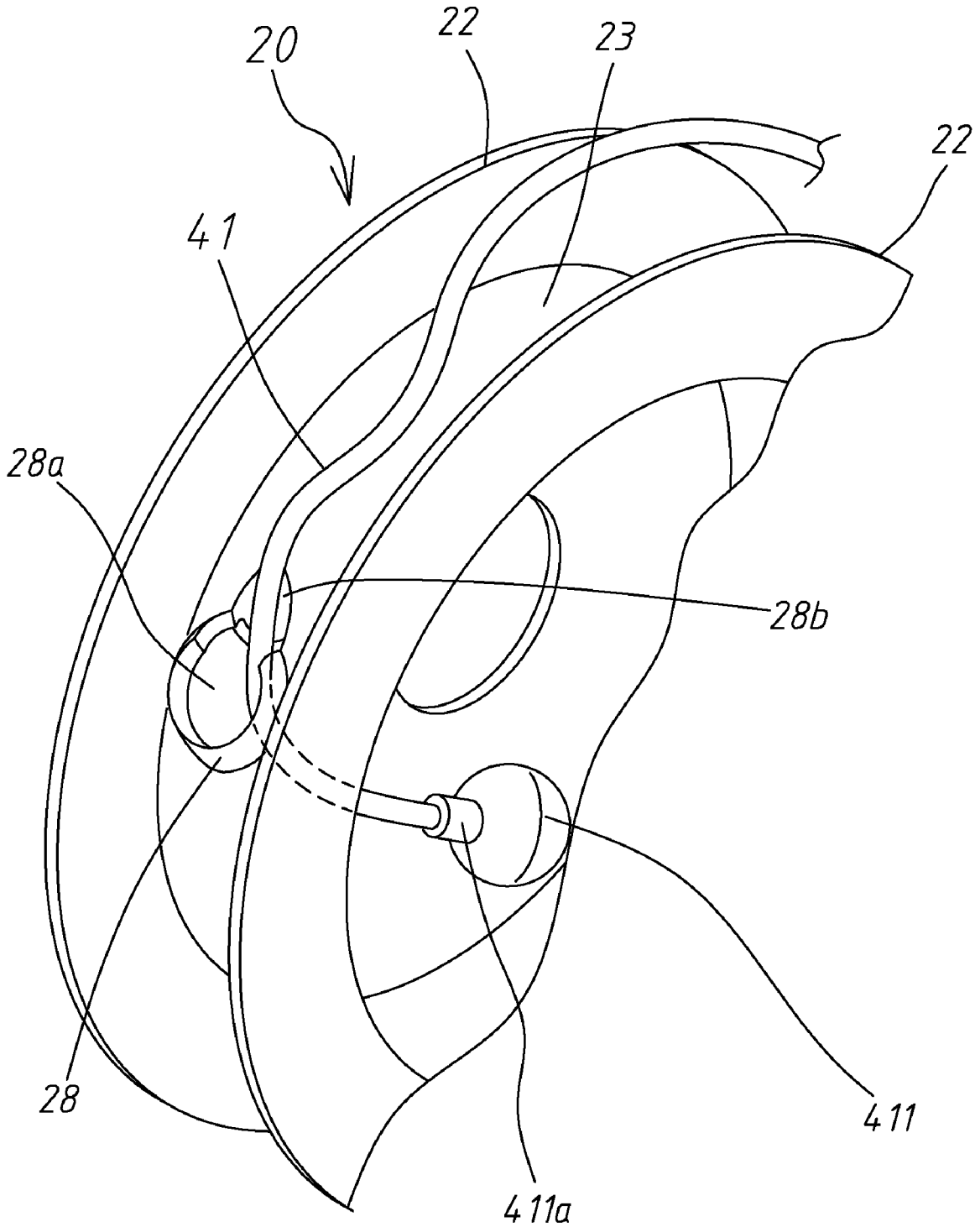
FIG. 5 is a schematic enlarged view of a part of the present invention, showing the structure of the rotor and the connection arrangement between the pull rope and the ball.
Figure 6:
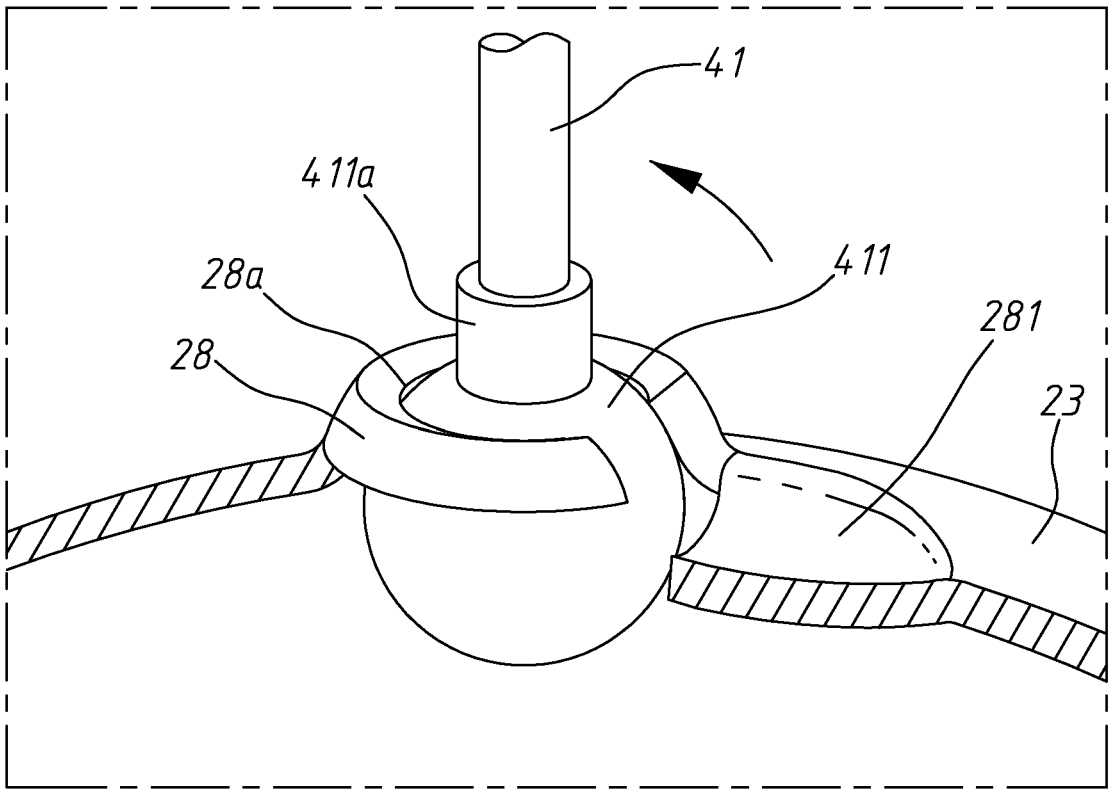
FIG. 6 is a schematic drawing of the present invention, showing the ball of the operation control device positioned in the ball socket of the rotor and the inner end of the pull rope kept perpendicular relative to the ball socket.
Figure 7:
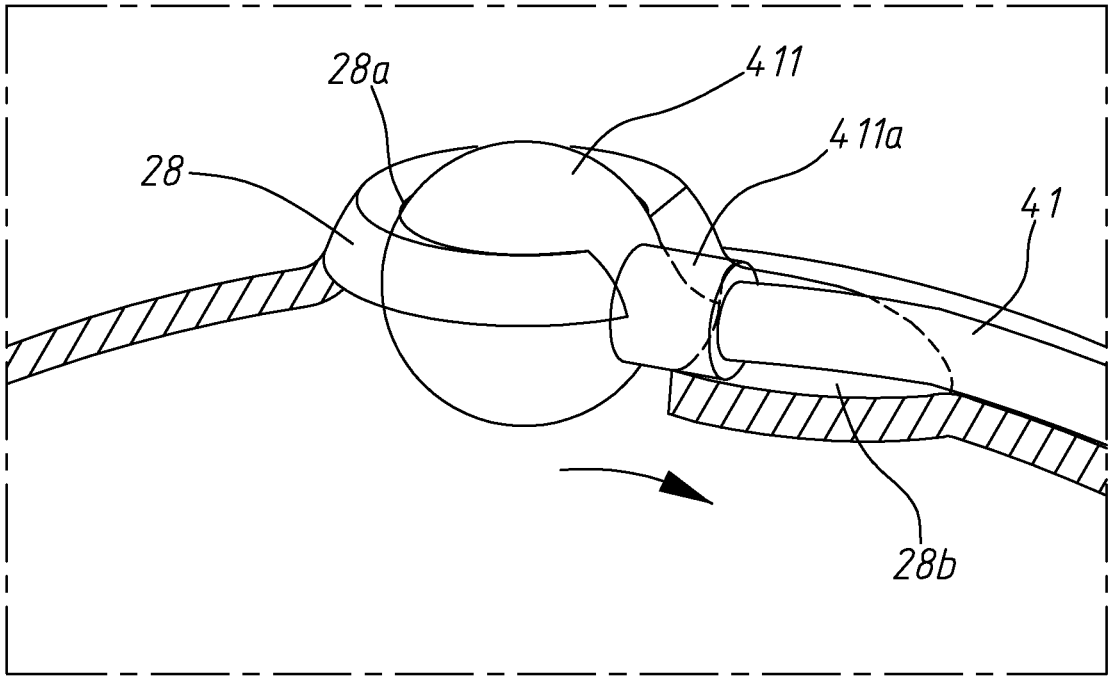
FIG. 7 is similar to FIG. 6 but showing the inner end of the pull rope kept in horizontal relative to the ball socket.

The operation control device 40 comprises a pull rope 41, a control member 42, a ball 43, a locating bush 44 and a ring 45. Any of a variety of other suitable ornamental members may be used to substitute for the ring 45. The pull rope 41 has its one end, namely, the inner end inserted through a hole 28*a* on the ball socket 28 and fixedly mounted with a spherical end member 411. The spherical end member 411 is received in the ball socket 28, having a tubular flange 411*a* wrapped about the inner end of the pull rope 41. The diameter of the hole 28*a* is smaller than the maximum diameter of the spherical end member 411 but greater than the outer diameter of the tubular flange 411*a*. Thus, the spherical end member 411 is prohibited from passing through the ball socket 28, however the spherical end member 411 can be rotated in the ball socket 28 or moved inside the rotor 20, as shown in FIG. 5. The rotor 20 further has a notch 28*b* located on the periphery of the hollow cylindrical body 23 and cut through the ball socket 28 for receiving the tubular flange 411*a* so that the spherical end member 411 can be moved with the pull rope 41 relative to the rotor 20 within a wide range, as shown in FIGS. 6 and 7. When the tubular flange 411*a* is received in the notch 28*b*, the pull rope 41 can be closely attached to the periphery of the hollow cylindrical body 23 and wound round the hollow cylindrical body 23.

This structure facilitates winding of the pull rope 41, prevents direct friction between the pull rope 41 and the peripheral edge of the hole 28*a* of the ball socket 28 and enhances positioning of the pull rope 41 on the periphery of the hollow cylindrical body 23 when the pull rope 41 is been wound round the round the hollow cylindrical body 23. Further, subject to the design of the notch 28*b* for receiving the tubular flange 411*a* of the spherical end member 411, the spherical end member 411 and the pull rope 41 will be moved toward the notch 28*b* and closely attached to the periphery of the hollow cylindrical body 23. The pull rope 41 is wound around the periphery of the hollow cylindrical body 23 between the two flanges 22 of the rotor 20, having its other end, namely, the outer end 412 extended out of the housing 10 and connected with the control member 42.

The control member 42 is a hollow cone adapted to hold the ball 43 on the inside. It is to be understood that the control member 42 can be made in any of a variety of other shapes. The outer end 412 of the pull rope 41 is inserted through the control member 42 and the ball 43, and then tied up to prohibit escape of the control member 42 and the ball 43 from the pull rope 41. The ball 43 has a positioning flange 431 protruded from the periphery and insertable through the top side of the control member 42. The locating bush 44 is mounted in the periphery of the housing 10 for the passing of the pull rope 41. The inner diameter 441 of the locating bush 44 is greater than the positioning flange 431 of the ball 43. Thus, when the pull rope 41 is wound round the hollow cylindrical body 23 of the rotor 20 subject to the spring force of the power spring 30, the positioning flange 431 and a part of the periphery of the ball 43 protrude over the top side of the control member 42 and positioned in the inner diameter 441 of the locating bush 44, thereby holding the control member 42 in place, as shown in FIG. 3. Further, the ring 45 is connected to the control member 42 for holding, for example a key 5, as shown in FIG. 8.

The control member 42, ball 43 and locating bush 44 of the operation control device 40 that are connected to the pull rope 41 work as a universal joint that allows the key 5 to be moved in all directions within a limited range. Further, the ball 43 has a locating hole 43*a*. After insertion of the outer end 412 of the pull rope 41, the outer end 412 is tied into a knot and received in the locating hole 43*a*. Further, there is a specific function provided between the positioning flange 431 of the ball 43 and the control member 42. When a stress is produced at the outer end 412 of the pull rope 41 during operation of the operation control device 40, the outer end 412 of the pull rope 41 can be rotated relative to the ball 43 to release the stress, and the positioning flange 431 of the ball 43 enhances the fulcrum (point of strength) between the pull rope 41 and the ball 43, facilitating twisting or oscillation of the pull rope 41 relative to the control member 42 and avoiding direct friction between the pull rope 41 and the control member 42. The control member 42 works as a connector between the auto-reversible reel and the object in use. The internal space of the hollow structural design of the control member 42 allows rotation of the ball 43 therein. Further, the control member 42 has a hole on the top side thereof for the passing of the positioning flange 431 and a part of the periphery of the ball 43 so that the positioning flange 431 and a part of the periphery of the ball 43 can protrude over the top side of the control member 42 and can be positioned in the inner diameter 441 of the locating bush 44 and rotated relative to the control member 42. The locating bush 44 allows moving of the pull rope 41 in and out of the housing 10, and fits the configuration of the top side of the control member 42 for positioning, avoiding vibration of the operation control device 40 relative to the housing 10 or friction between the locating bush 44 and the pull rope 41 after return of the power spring 30 and winding of the pull rope 41 round the rotor 20.

Figure 8:
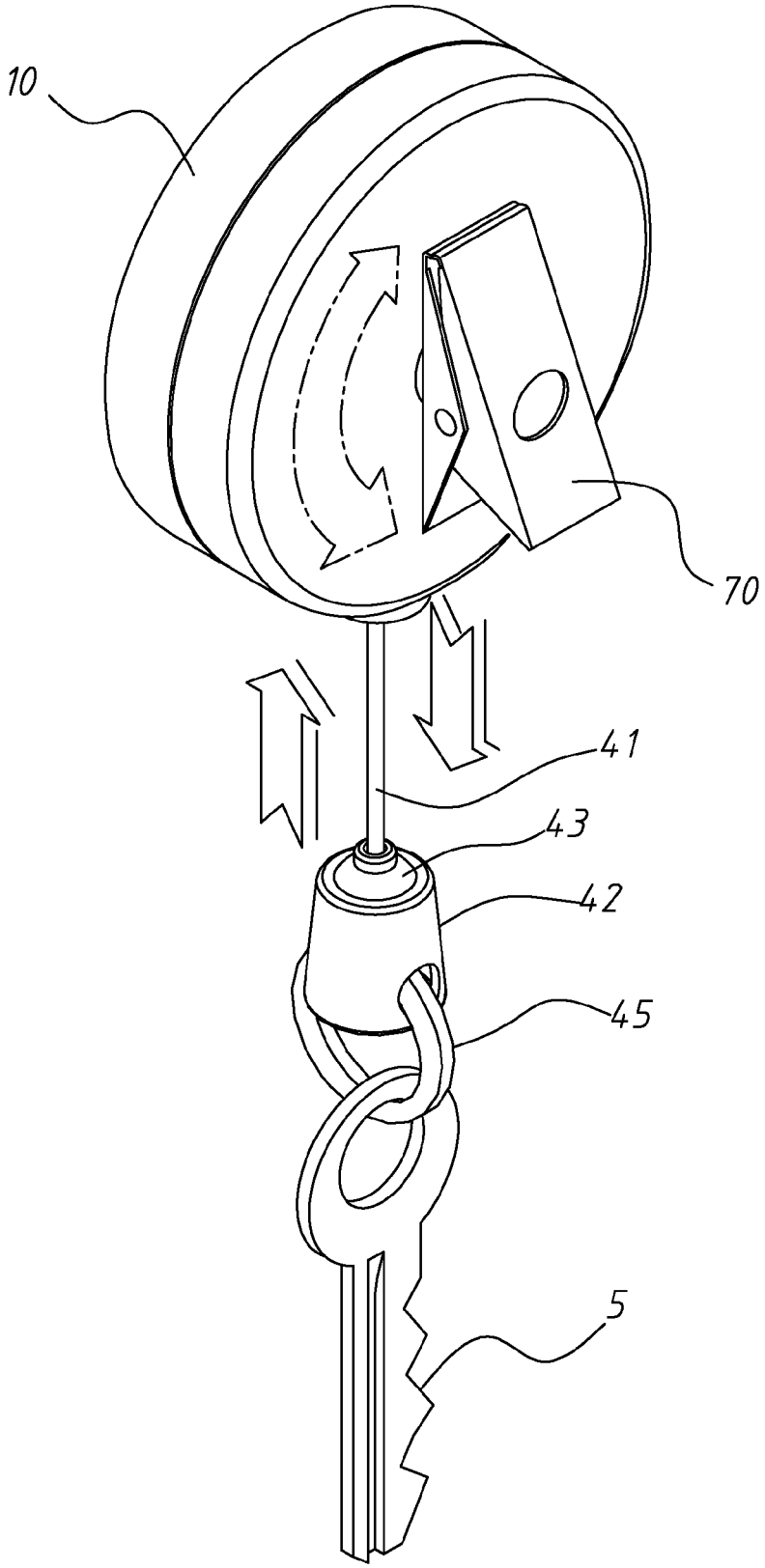
FIG. 8 is a schematic drawing of the present invention, showing a key fastened to the ring at the control member and the pull rope pulled vertically downwardly out of the housing.

When in use, as shown in FIG. 8, the control member 42 is pulled outwards (as indicated by the downward arrowhead in FIG. 8) to carry the pull rope 41 out of the housing 10, causing the rotor 20 to be rotated about the shaft 111. When the pull rope 41 is being let off, the power spring 30 is wound round the shaft 111 (because the inner end 31 of the power spring 30 is fastened to the shaft 111 and the outer end 32 of the power spring 30 is fastened to the inside of the rotor 20, rotating the rotor 20 causes the power spring 30 to be wound round the shaft 111). When the pull force disappears, the tensile force of the power spring 30 reverses the rotor 20 to take up the pull rope 41, as indicated by the upward arrowhead in the FIG. 8.

Further, the design of the single rotor 20 simplifies the assembly process of the auto-reversible reel. Further, the matching design between the retaining hole 33 and the retaining block 26 assures positive positioning of the outer end 32 of the power spring 30, avoiding accidental disconnection of the power spring 30.

Figure 9:
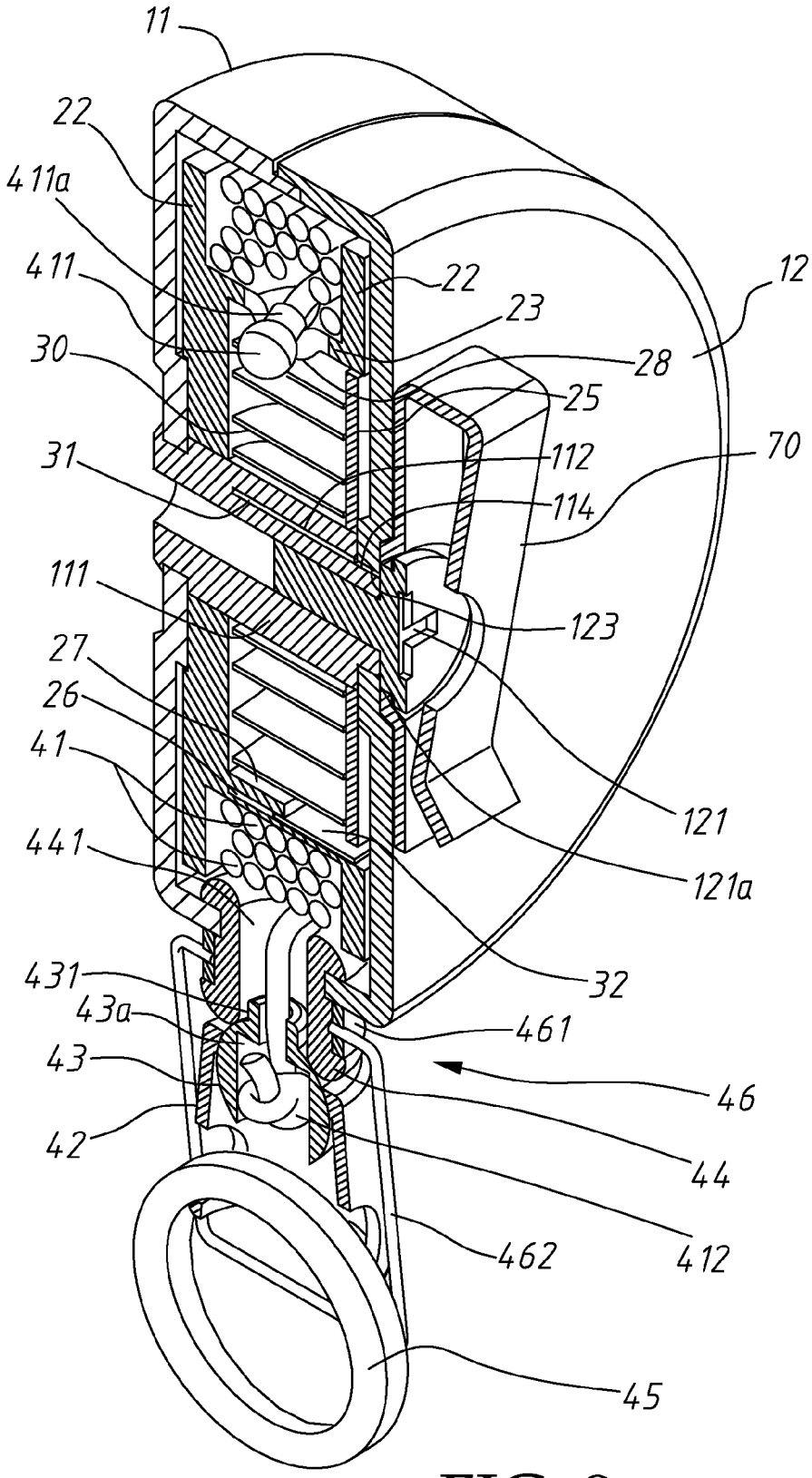
FIG. 9 is a sectional elevation of an alternate form of the present invention, showing the connection member made in the form of a clip and a swivel fastened to the positioning bush.

Further, the right cover shell 12 has a circular recess 122 located on the outside wall in a concentric manner relative to the center hole 123. Further, the connection member 70 has its one end connected to fastening member 121 and configured to fit the circular recess 122 in such a manner that the connection member 79 can be turned about the fastening member 121 relative to the housing 10 through 360°. As shown in FIG. 9, the fastening member 121 is inserted through the center hole 123 of the right cover shell 12 and driven into the locating hole 113 to affix the right cover shell 12 and the left cover shell 11 together, having a mounting portion 121*a* fitting the step 114 of the shaft 111 tightly and allowing turning of the connection member 70 about the fastening member 121.

Figure 10:
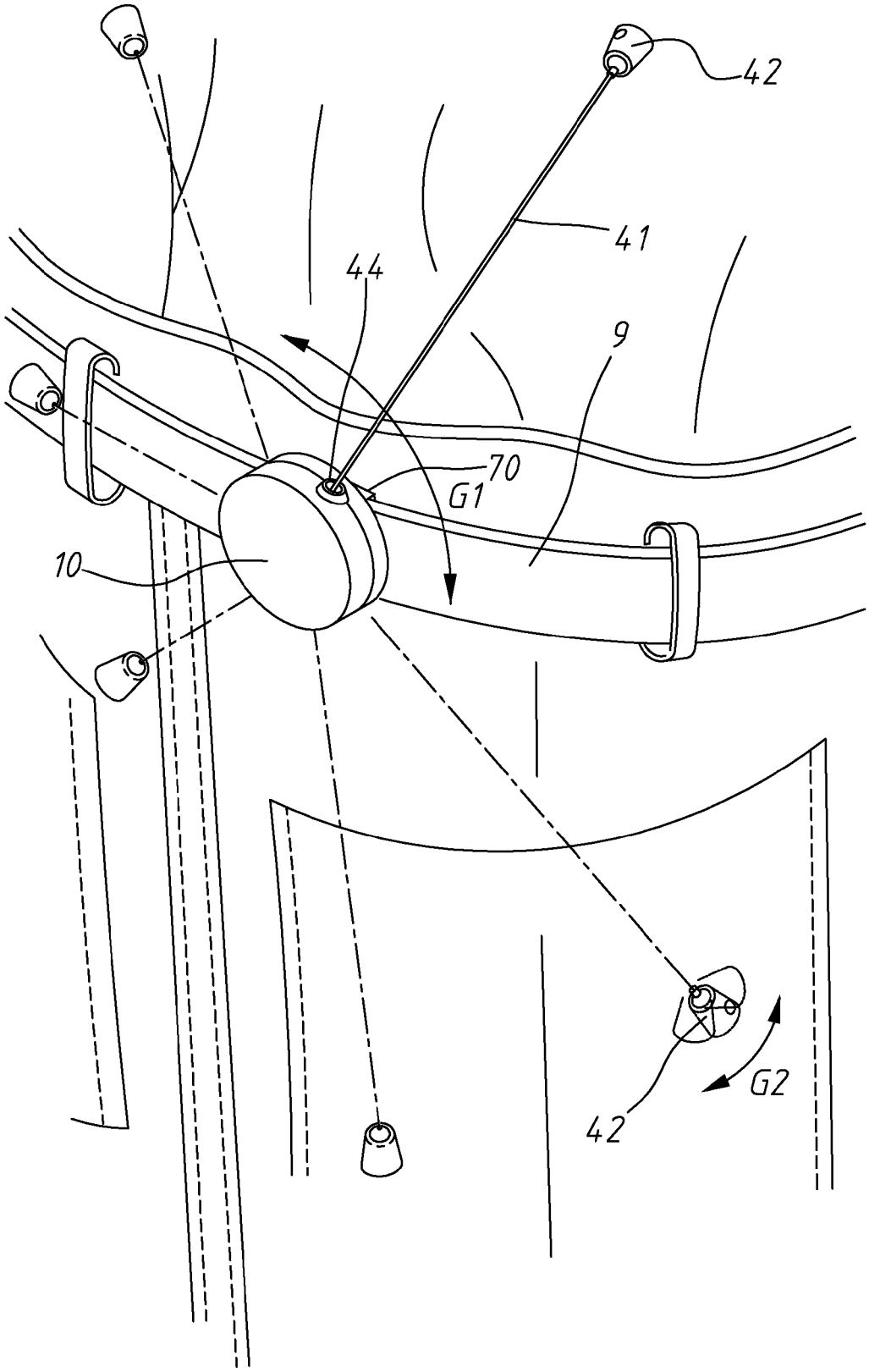
FIG. 10 is a schematic applied view of the present invention, showing the auto-reversible reel fastened to the user's waist belt.

Referring to FIG. 9 again, the connection member 70 according to this embodiment is a clip. By means of the connection member 70, the auto-reversible reel can be fastened to, for example, the user's waist belt 9, as shown in FIG. 10, allowing rotation of the housing 10 relative to the connection member 70 through 360°, as indicated by the arrowhead sign G1. Thus, the user can operate the control member 42 to pull the pull rope 41 out of the housing 10 in any direction, as indicated by the imaginary lines in FIG. 10. Further, the control member 42 can be rotated through 360° or swung relative to the pull rope 41, as indicated by the arrowhead sign G2.

Figure 11:
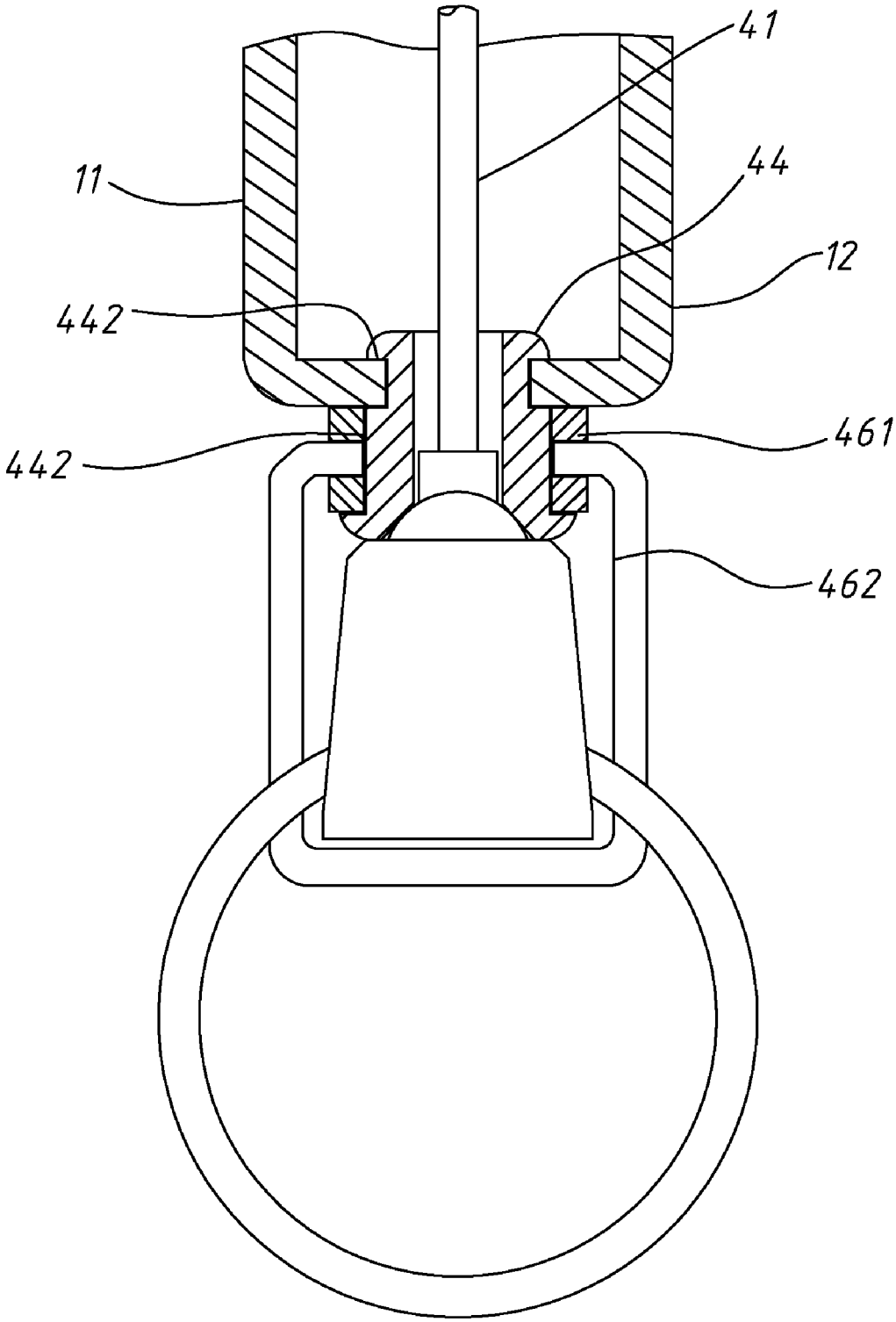
FIG. 11 is a schematic sectional view of a part of the auto-reversible reel shown in FIG. 9.

Referring to FIGS. 9 and 11, the positioning bush 44 of the operation control device 40 has a mounting groove 442 extending around the periphery for the engagement of the left cover shell 11 and the right cover shell 12. Further, a swivel 46 is coupled to the positioning bush 44. As illustrated, the swivel 46 comprises a ring 461 rotatably coupled to the mounting groove 442 of the positioning bush 44 outside the left cover shell 11 and the right cover shell 12, and a C-shaped hook 462 that has two distal ends thereof respectively radially inserted through the peripheral wall of the ring 461 into the mounting groove 442 of the positioning bush 44. The C-shaped hook 462 can be used to carry car remote control device or any other personal item. Thus, the C-shaped hook 462 can be swung relative to the ring 461, and the ring 461 can be rotated relative to the positioning bush 44.

Figure 12:
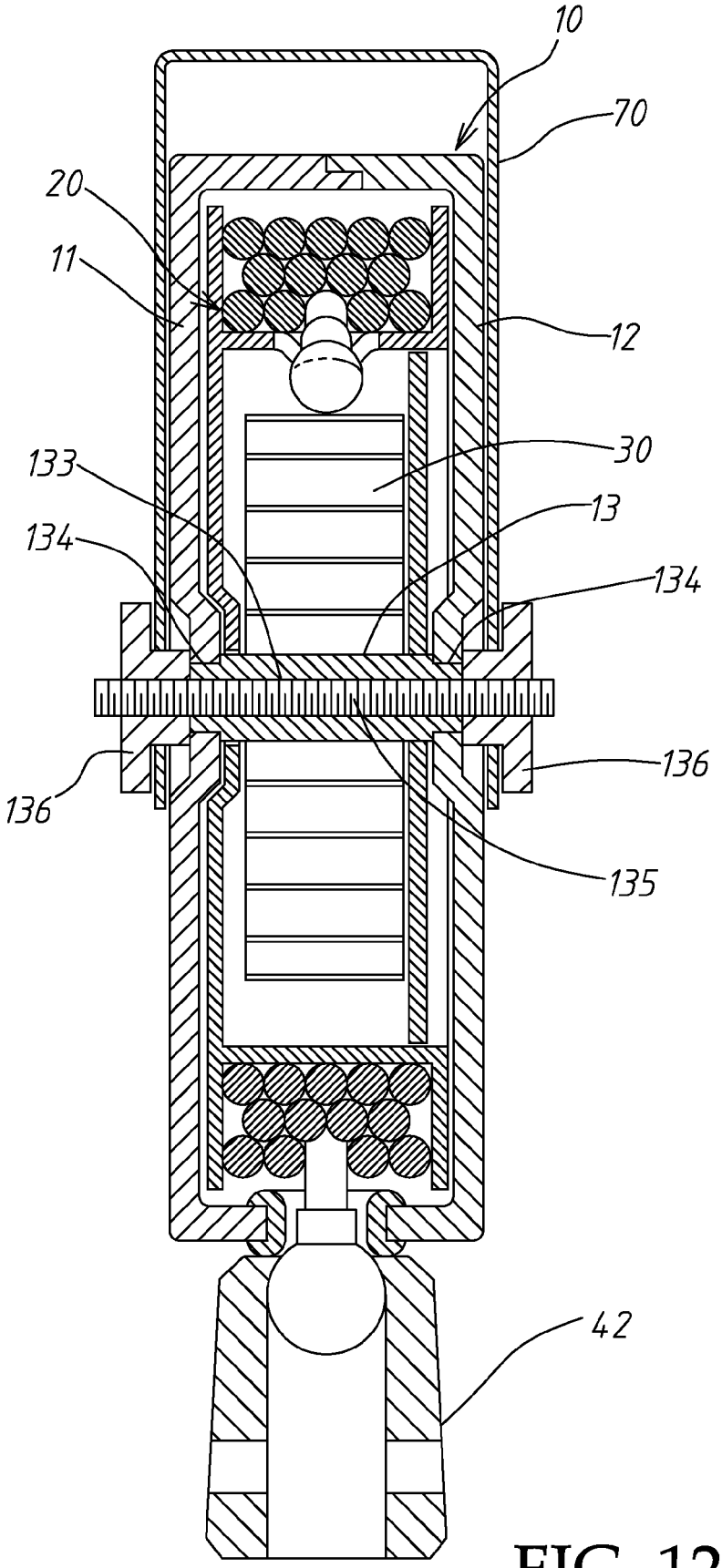
FIG. 12 is a sectional view of another alternate form of the present invention.

FIG. 12 shows another alternate form of the present invention. According to this embodiment, a detachable shaft 13 is used to substitute for the aforesaid shaft 111 to support the rotor 20. The detachable shaft 13 has two end flanges 134 respectively inserted into a center hole (not shown) on the left cover shell 11 and a center hole (not shown) on the right cover shell 12, and an axial hole 133 axially extending through the end flanges 134. Further, a screw rod 135 is inserted through the axial hole 133 of the detachable shaft 13. Further, two T-nuts 136 are respectively threaded onto the two distal ends of the screw rod 135 to secure the detachable shaft 13 to the housing 10. Further, the connection member 70 is a substantially U-shaped frame pivotally coupled to the two T-nuts 136. Thus, the housing 10 and the rotor 20 can be rotated through 360° relative to the connection member 70.

Figure 13:
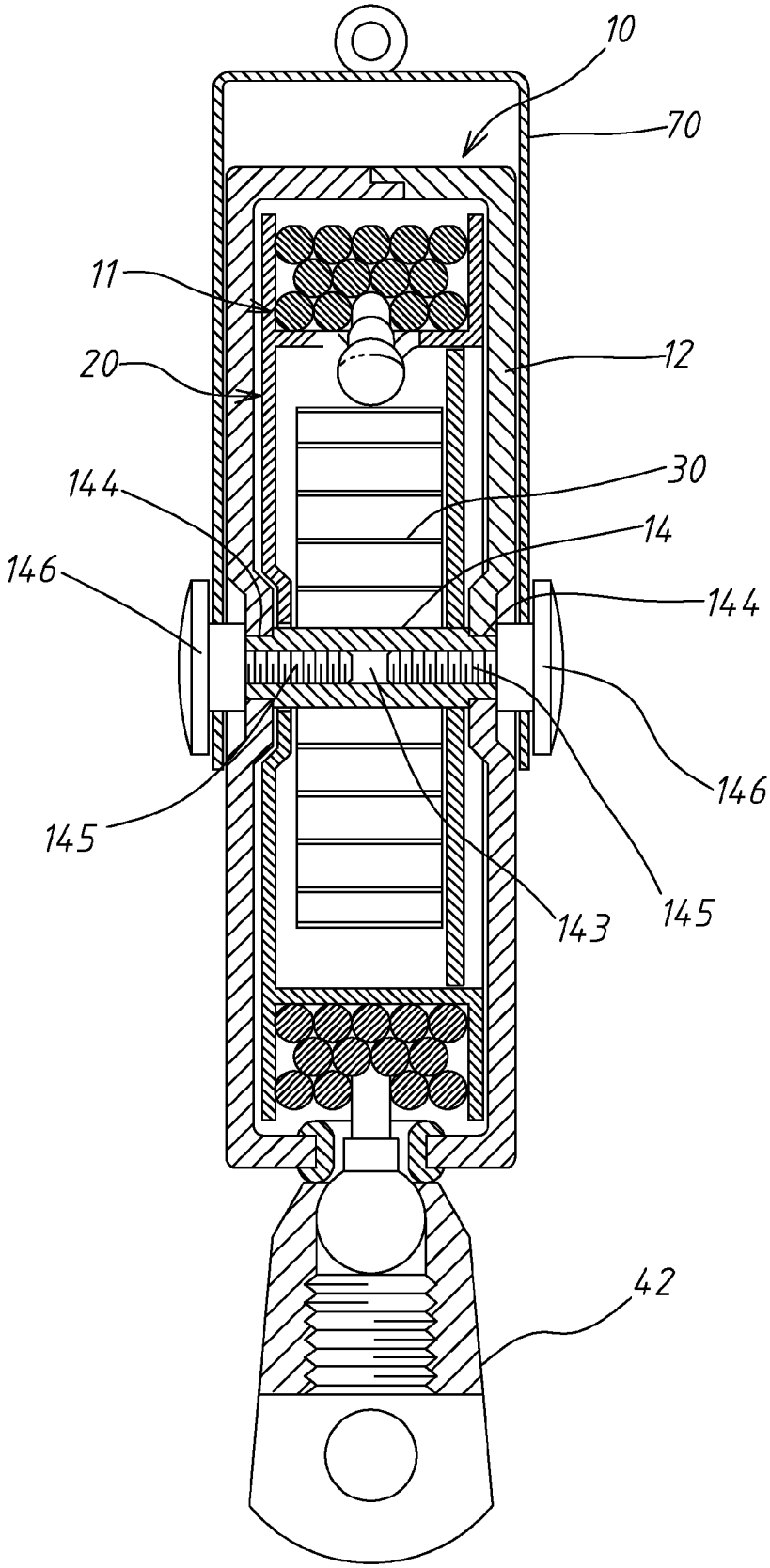
FIG. 13 is a sectional view of still another alternate form of the present invention.

FIG. 13 shows still another alternate form of the present invention. According to this embodiment, a detachable shaft 14 is used to support the rotor 20 instead of the aforesaid shaft 111. The detachable shaft 14 has two end flanges 144 respectively inserted into a center hole (not shown) on the left cover shell 11 and a center hole (not shown) on the right cover shell 12, and an axial hole 143 axially extending through the end flanges 144. Further, two screw members 145 are respectively threaded into the axial hole 143 of the detachable shaft 14 to affix the detachable shaft 14 to the left cover shell 11 and the right cover shell 12. Each screw member 146 has a T-shaped head 146 stopped against the outside wall of the left cover shell 11 or right cover shell 12. Further, the connection member 70 is a substantially U-shaped frame pivotally coupled to the T-shaped head 146 of the screw members 145. Thus, the housing 10 and the rotor 20 can be rotated through 360° relative to the connection member 70.

Figure 14:
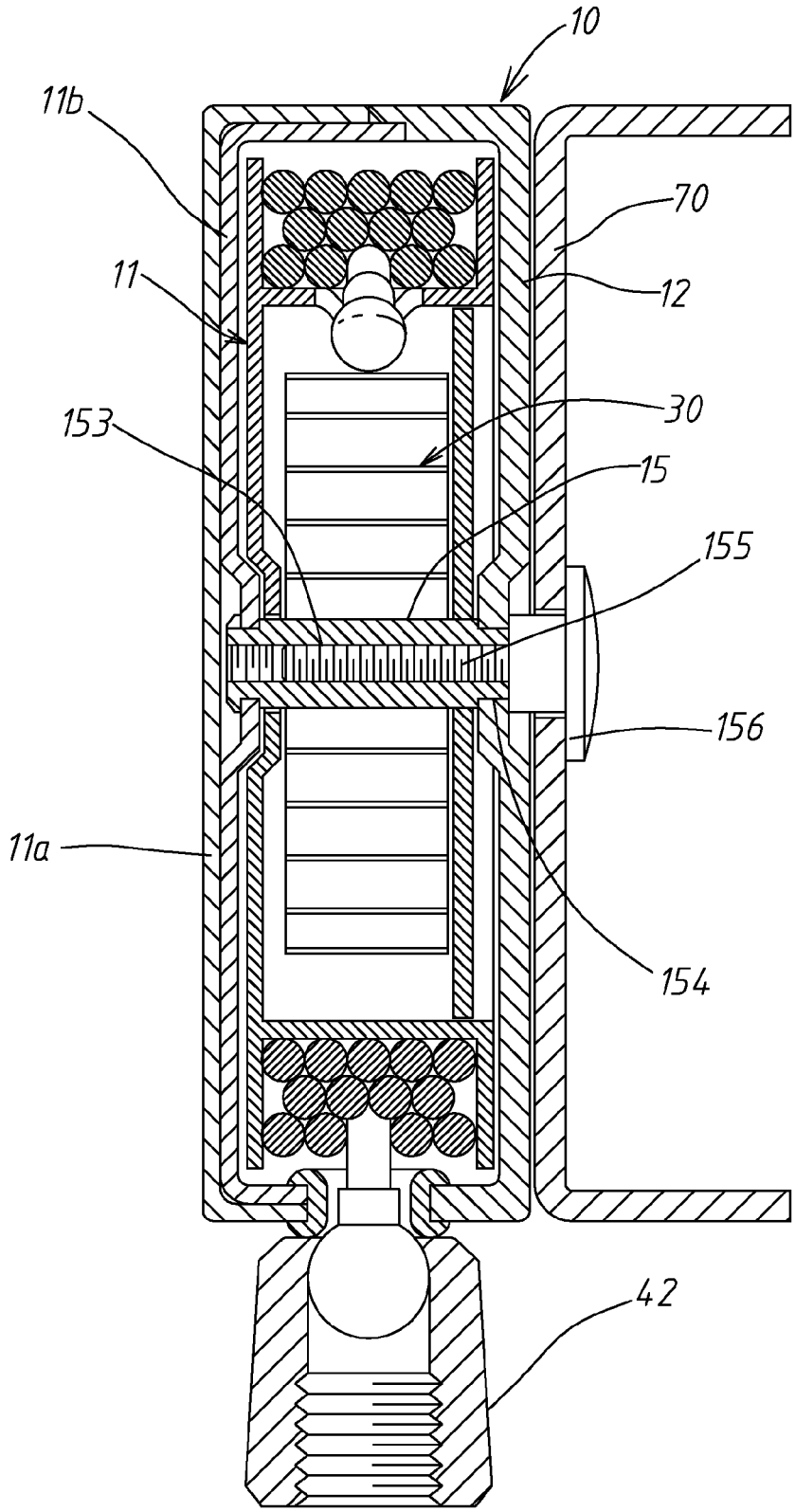
FIG. 14 is a sectional view of still another alternate form of the present invention.

FIG. 14 shows still another alternate form of the present invention. According to this embodiment, the left cover shell 11 comprises an outer cover shell layer 11*a* and an inner cover shell haler 11*b* surrounded by the outer cover shell layer 11*a*; a detachable shaft 15 is used to support the rotor 20 instead of the aforesaid shaft 111. The detachable shaft 15 has two end flanges 154 respectively inserted into a center hole (not shown) on inner cover shell 11*b* of the left cover shell 11 and a center hole (not shown) on the right cover shell 12, and an axial hole 153 axially extending through the end flanges 154. Further a screw member 155 is inserted through the center hole (not shown) on the right cover shell 12 and driven into the axial hole 153 of the detachable shaft 15 to affix the detachable shaft 15 to the left cover shell 11 and the right cover shell 12. The screw member 155 has a T-shaped head 156 disposed outside the housing 10. Further, the connection member 70 is a substantially U-shaped frame pivotally coupled to the T-shaped head 156 of the screw member 155 at one side of the housing 10. Thus, the housing 10 and the rotor 20 can be rotated through 360° relative to the connection member 70.

Referring to FIGS. 12~14, the control member 42 can be made in any of a variety of shapes and designs.

Although particular embodiment of the invention have been described in detail for purposes of illustration, various modifications and enhancements may be made without departing from the spirit and scope of the invention. Accordingly, the invention is not to be limited except as by the appended claims.

What the invention claimed is:

1. An auto-reversible reel, comprising:

a housing, said housing comprising a left cover shell, a right cover shell attached to said left cover shell, and an inside shaft connected between said left cover shell and said right cover shell, said inside shaft having a longitudinal crevice and an axially extending locating hole;

a rotor accommodated inside said housing between said left cover shell and said right cover shell, said rotor comprising a hollow cylindrical body, an axial hole cut through said hollow cylindrical body and coupled to said inside shaft of said left cover shell for allowing rotation of said rotor about said inside shaft of said left cover shell, two flanges respectively radially extending around two distal ends of the periphery of said hollow cylindrical body and a power spring accommodation chamber defined in one side of said hollow cylindrical body;

a power spring mounted in said power spring accommodation chamber, said power spring having an inner end thereof fastened to the longitudinal crevice of said inside shaft of said left cover shell and an outer end fastened to an inside wall of said hollow cylindrical body of said rotor; and an operation control device, said operation control device comprising a pull rope and a control member, said pull rope being wound round said hollow cylindrical body of said rotor and having a first end thereof fastened to said rotor and a second end thereof extending out of said housing and connected to said control member;

wherein a user operates said control member to pull said pull rope out of said housing, said rotor is rotated about said inside shaft of said left cover shell and said power spring is wound round said inside shaft of said left cover shell; when the user release the hand from said control member, the tensile force of said power spring reverses said rotor to wind back said pull rope;

wherein said power spring has a retaining hole at the outer end thereof for mounting; said rotor comprises a retaining block located inside said hollow cylindrical body for the fastening of the retaining hole of said power spring, and a stop plate located inside said hollow cylindrical body and suspending above said retaining block to prohibit disconnection of said retaining hole of said power spring from said retaining block.

2. The auto-reversible reel as claimed in claim 1, wherein said power spring further has a side opening located on one lateral side of the outer end thereof in communication with said retaining hole, the width of said side opening being shorter than the diameter of said retaining hole.

3. The auto-reversible reel as claimed in claim 1, wherein said rotor further comprises a ball socket formed integral with the periphery of said hollow cylindrical body, said ball socket having a hole cut therethrough; the first end of said pull rope of said operation control device is inserted through the hole on said ball socket and fixedly mounted with a spherical end member that is receivable in said ball socket.

4. The auto-reversible reel as claimed in claim 3, wherein said spherical end member comprises a tubular flange wrapped about the first end of said pull rope; the diameter of the hole of said ball socket is smaller than the maximum diameter of said spherical end member and greater than the outer diameter of said tubular flange of said spherical end member so that said spherical end member is prohibited from passing through the hole of said ball socket and rotatable in said ball socket.

5. The auto-reversible reel as claimed in claim 3, wherein said rotor further comprises a notch located on the periphery of said hollow cylindrical body and cut through said ball socket for receiving said tubular flange of said spherical end member so that said spherical end member is movable with said pull rope between the hole of said ball socket and the notch of said rotor for enabling said pull rope to be closely attached to the periphery of said hollow cylindrical body of said rotor and wound round said hollow cylindrical body of said rotor.

6. The auto-reversible reel as claimed in claim 1, wherein said rotor further comprises a cover plate attached to said hollow cylindrical body to close said power spring accommodation chamber after installation of said power spring in said power spring accommodation chamber, said cover plate having a center hole for the passing of said inside shaft of said left cover shell.

7. The auto-reversible reel as claimed in claim 1, wherein said control member is a hollow cone and allows passing of a positioning flange of a ball through a top wall thereof; said operation control device further comprises said ball receivable in said control member and a locating bush mounted in the periphery of said housing for the passing of said pull rope, said ball having a locating hole through which the outer end said pull rope is inserted and fastened thereto and said positioning flange insertable through a hole on the top wall of said control member, said locating bush having an inner diameter greater than said positioning flange of said ball so that said positioning flange and a part of the periphery of said ball protrude over the top side of said control member and positioned in the inner diameter of said locating bush when said pull rope is wound round said hollow cylindrical body of said rotor subject to the spring force of said power spring.

8. The auto-reversible reel as claimed in claim 7, wherein said operation control device further comprises a ring fastened to said control member.

9. The auto-reversible reel as claimed in claim 7, wherein said locating bush has a mounting groove extending around the periphery thereof and a swivel coupled to said mounting groove, said swivel comprising a ring mounted in said mounting groove and rotatable relative to said locating bush and a C-shaped hook pivotally coupled to said ring.

10. The auto-reversible reel as claimed in claim 1, wherein said inside shaft has one end thereof formed integral with said left cover shell and an opposite end thereof inserted into a center hole on said right cover shell and affixed thereto by a fastening member; a connection member is pivotally connected to said fastening member outside said housing for the connection of an external object.

11. The auto-reversible reel as claimed in claim 1, wherein said inside shaft is detachably mounted in said housing, having two end flanges respectively inserted into a center hole on said left cover shell and a center hole on said right cover shell and an axial hole extending through said two end flanges; a screw rod is inserted through the axial hole of said inside shaft and screwed up with two T-nuts that are respectively stopped outside said housing; a U-shaped connection member is pivotally coupled to said T-nuts outside said housing for the connection of an external object such that said housing and said rotor are rotatable through 360° relative to said connection member.

12. The auto-reversible reel as claimed in claim 1, wherein said inside shaft is detachably mounted in said housing, having two end flanges respectively inserted into a center hole on said left cover shell and a center hole on said right cover shell and an axial hole extending through said two end flanges; two screw members are respectively inserted through said left cover shell and said right cover shell and threaded into the axial hole of said inside shaft to secure said inside shaft to said housing, said screw member each having a head disposed outside said housing; a U-shaped connection member is pivotally coupled to said screw members outside said housing for the connection of an external object such that said housing and said rotor are rotatable through 360° relative to said connection member.

13. The auto-reversible reel as claimed in claim 1, wherein said left cover shell comprises an inner cover shell layer and an outer cover shell layer surrounding said inner cover shell layer; said inside shaft is detachably mounted in said housing, having two end flanges respectively inserted into a center hole on said inner cover shell layer of said left cover shell and a center hole on said right cover shell and an axial hole extending through said two end flanges; a screw member is inserted through said right cover shell and threaded into the axial hole of said inside shaft to secure said inside shaft to said housing, said screw member each having a T-shaped head disposed outside said housing; a U-shaped connection member is pivotally coupled to the T-shaped head of said screw member outside said housing for the connection of an external object such that said housing and said rotor are rotatable through 360° relative to said connection member.

* * * * *